US006924751B2

(12) United States Patent
Hempel et al.

(10) Patent No.: US 6,924,751 B2
(45) Date of Patent: Aug. 2, 2005

(54) METHOD FOR TRANSMITTING DIGITALLY ENCODED TRAFFIC MESSAGES

(75) Inventors: Karin Hempel, München (DE); Heinrich Schmidt, Diekholzen (DE)

(73) Assignee: Robert Bosch GmbH, Stuttgart (DE)

( * ) Notice: Subject to any disclaimer, the term of this patent is extended or adjusted under 35 U.S.C. 154(b) by 90 days.

(21) Appl. No.: 10/110,148

(22) PCT Filed: May 9, 2001

(86) PCT No.: PCT/DE01/01770

§ 371 (c)(1),
(2), (4) Date: Aug. 19, 2002

(87) PCT Pub. No.: WO02/13161

PCT Pub. Date: Feb. 14, 2002

(65) Prior Publication Data

US 2003/0102986 A1 Jun. 5, 2003

(30) Foreign Application Priority Data

Aug. 9, 2000 (DE) ..... 100 38 765

(51) Int. Cl.[7] ..... G08G 1/123

(52) U.S. Cl. ..... 340/995.12; 340/905; 340/907; 340/988; 340/990; 370/349; 370/310; 370/312; 370/328

(58) Field of Search ..... 340/995.12, 995.13, 340/905, 907, 988, 990, 995, 995.11, 995.1, 993; 370/310, 312, 328, 336, 349, 343; 701/207, 208, 209, 213, 24; 455/45, 185.1, 186.1

(56) References Cited

U.S. PATENT DOCUMENTS 5,991,610 A * 11/1999 Ruhl et al. ..... 455/186.1
6,434,138 B2 * 8/2002 Kersken et al. ..... 370/349
6,477,459 B1 * 11/2002 Wunderlich ..... 701/209

FOREIGN PATENT DOCUMENTS

| | | |
|---|---|---|
| DE | 35 36 820 | 4/1987 |
| DE | 42 37 987 | 5/1994 |
| DE | 195 47 387 | 6/1997 |
| DE | 199 05 893 | 8/2000 |
| WO | WO 95/19668 | 7/1995 |

OTHER PUBLICATIONS

Mitterhummer et al., "Datenrundfunk Mit Dab", Funkschau, Franzis–Verlag K.G. Munchen, Germany, vol. 67, No. 22, Oct. 13 1995, pp. 45–48*

* cited by examiner

*Primary Examiner*—Hung Nguyen
(74) *Attorney, Agent, or Firm*—Kenyon & Kenyon

(57) ABSTRACT

In a method of transmitting digitally encoded traffic messages, the traffic messages being transmitted according to a standardized structure, in particular according to the TMC method, where a header precedes the digitally encoded traffic messages, and the digitally encoded traffic message is followed by at least one additional item of information, and one of these items of information contains a place description, the additional information is divided into classes, each class having a class identifier and at least one packet. One class contains presentation data.

17 Claims, 2 Drawing Sheets

METHOD FOR TRANSMITTING DIGITALLY ENCODED TRAFFIC MESSAGES

BACKGROUND INFORMATION

German Patent No. 35 36 820 describes a design for receivers in which traffic messages are transmitted in a standardized manner. Route guidance names, usually place names, are assigned to predetermined freeway numbers or highway numbers and standard texts are provided to permit very rapid transmission of encoded traffic messages. The highway numbers, route guidance names and other place names as well as the standard texts are filed in a memory and are also carried in a corresponding radio receiver. If a traffic bottleneck occurs, the information is transmitted digitally in the form of abbreviations and then is compiled in the radio receiver to form a complete message. This achieves the result that complete traffic messages may be transmitted with very few bytes, so that a great many traffic messages may be transmitted in a relatively short period of time even with less efficient data transmission systems.

This becomes problematical when the freeway or highway designations have changed or place names or other route guidance names have been changed as part of restructuring measures. Then place name information is reproduced by a radio receiver equipped with a corresponding memory, but it is no longer readable in this form on traffic signs, for example, so the driver becomes irritated.

To eliminate these disadvantages, German Patent Application No. 199 05 893 describes a method of transmitting digitally encoded traffic messages.

This makes it possible to deal with revised place names and also to transmit place names which are not provided in an original memory of the radio receiver. In addition, since there has been a steady increase in digital message transmission by radio, and furthermore since transmission methods which are also capable of transmitting a high data volume have recently become available, it is also possible to completely eliminate the need for a memory in the radio receiver or to file only the predetermined standard texts in this memory and to append the place information to the digitally encoded traffic message in general. This greatly increases the flexibility of the traffic messages to be transmitted digitally. The header is used to allow the radio receiver to recognize that not only are digitally encoded traffic messages being transmitted but also that the digitally encoded traffic data is being followed by place information or other additional information.

SUMMARY OF THE INVENTION

The method according to the present invention is based on the fact that the additional information is divided into classes, each class having a class identifier and at least one packet, and one class contains presentation data.

It is also possible to have access to the presentation information in the receiver in a targeted manner and to analyze it optimally.

In particular at least one packet may be provided for text data, graphic data, audio data or video data. Within the class (referred to as a presentation class below ) packets of different data may also be included, e.g., packets having text data for an alphanumeric display and packets having audio data for voice output.

It is preferable for each packet to be determined by the type and the data, where the type indicates the type of data, including the data format, e.g., ASCII in the case of text data, JPEG in the case of graphic data, WAVE in the case of audio data and MPEG in the case of video data.

Messages processed for presentation, in particular audio and text data, are dependent upon language. To be able to make a selection in the receiver, it is possible according to one refinement for the type of a packet to contain a language identifier. If multiple languages are supported, then a separate container of the presentation class having a specific first packet indicating the type of language is generated for each language.

DETAILED DESCRIPTION

Figure 1:
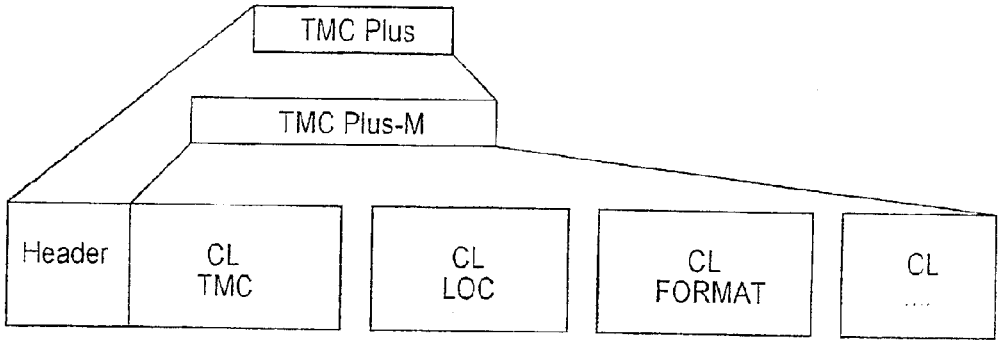
FIG. 1 shows the structure of an encoded traffic message according to the present invention.

The structure illustrated in FIG. 1 includes a TMC message (traffic message) according to the previous standard, transmitted in a class CL TMC. This is preceded by a header, indicating that the traffic message to be transmitted is an expanded message, which is designated as a whole, including the header, as TMC Plus in FIG. 1. The message itself (not including the header) is designated in FIG. 1 with TMC Plus-M (=message) and includes, in addition to class CL TMC which is always to be transmitted, a CL LOC, which is also always to be transmitted, namely a class having a place description. The following class CL FORMAT contains presentation formats which are explained in greater detail in conjunction with the additional figures. In addition, FIG. 1 also indicates the presence of an additional class CL.

Figure 2:
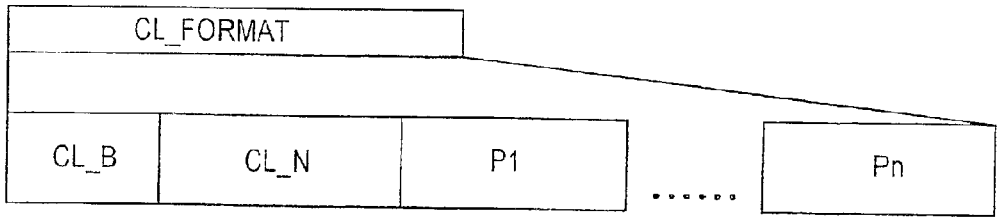
FIG. 2 shows the structure of a presentation class.

FIG. 2 shows the components of class $CL_{13}$FORMAT, namely a class identifier $CL_{13}B$ and the number $CL_{13}N$ of packets in the class. In this example, the class identifier indicates that this is a presentation format. Class $CL_{13}$FORMAT shown here also contains packets Pl through Pn, which are explained in greater detail below with reference to FIG. 3.

Figure 3:
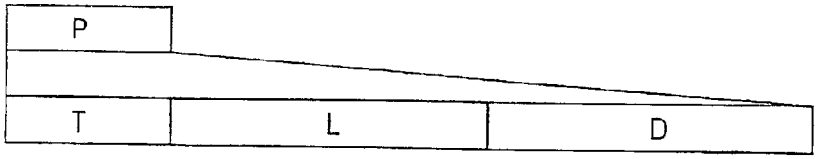
FIG. 3 shows the structure of a packet.

FIG. 3 shows schematically a packet P which includes a type identifier T, a length indicator L and data D.

Figure 4:
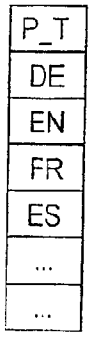
FIG. 4 shows a packet for language identification.
Figure 5:
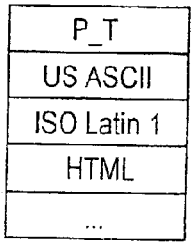
FIGS. 5 through 8 show various types of packets for the output formats of text, graphic, audio and video data.
Figure 6:
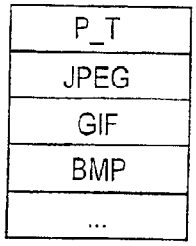
Figure 7:
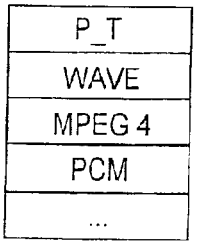
Figure 8:
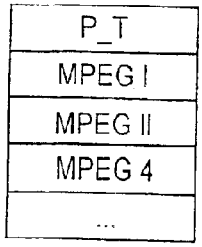

FIG. 4 shows schematically various possibilities for a packet type $P_{13}T$ for different languages, namely DE for German, EN for English, FR for French and ES for Spanish, although these may be expanded as desired.

According to FIGS. 5 through 8, various text formats may be used for text (FIG. 5), various graphic formats may be used for graphic data (FIG. 6), various audio formats for audio data (FIG. 7) and various video formats for video data (FIG. 8) as packet types.

Figure 9:
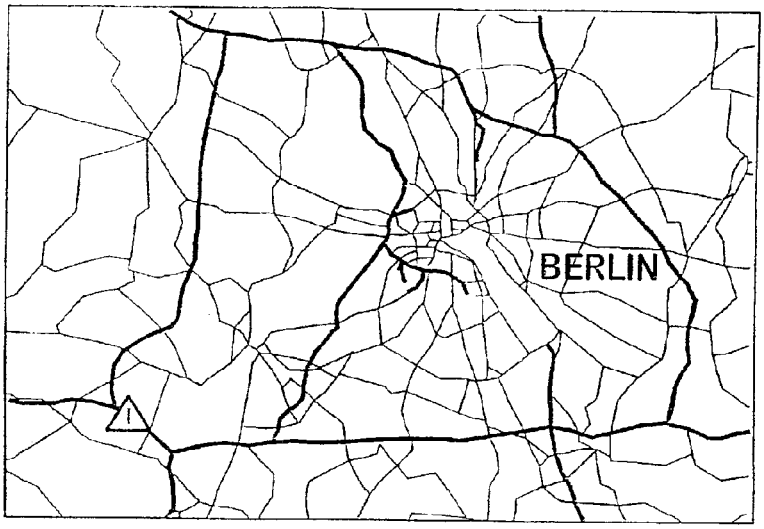
FIG. 9 shows an example of a graphic.
Figure 10:
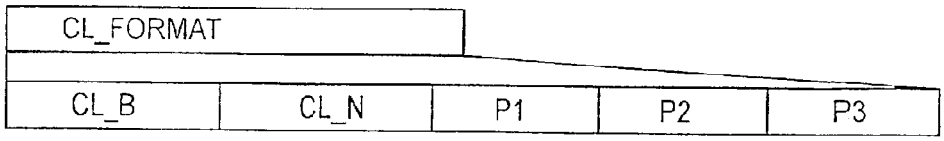
FIG. 10 shows an example of a presentation class.

On the basis of a concrete example, a TMC message transmitted as ASCII characters and as a graphic, the graphic being a section of a map, is described below (FIG. 9). In hexadecimal characters, the code transmitted in the traditional TMC message is 08086A27C5. The text in U.S. ASCII, for example, is "between AD Werder and AS Glindow 10 km traffic congestion." Class $CL_{13}$FORMAT for this message is illustrated schematically in FIG. 10 and includes class identifier $CL_{13}$B, the number of packets $CL_{13}$N and packets P1, P2 and P3.

Figure 11:
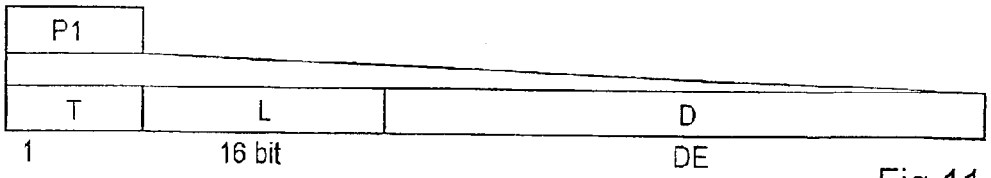
FIG. 11 shows an example of a packet for language identification.

According to FIG. 11, packet P1 is composed of a type identifier T=1, a length indicator of L=16 bits and a language identifier D=DE.

Figure 12:
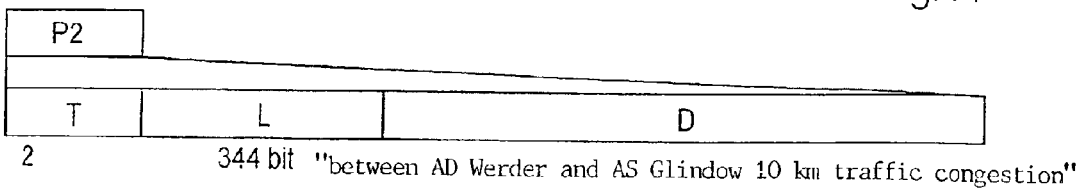
FIG. 12 shows an example of a packet having text data.

Second packet P2 illustrated in FIG. 12 contains a packet type T=2, which indicates that packet P2 contains text having a length of L=344 bits and data D="between AD Werder and AS Glindow 10 km traffic congestion."

Figure 13:
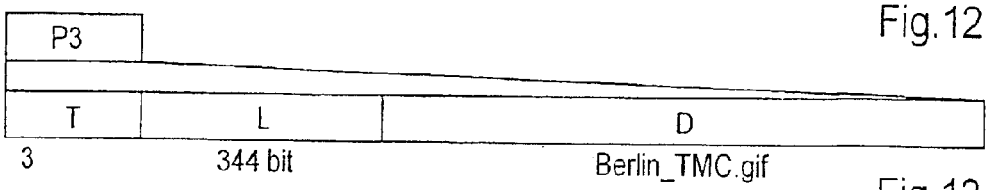
FIG. 13 shows an example of a packet having graphic data.

FIG. 13 shows third packet P3 where T=3 (=graphic), L=344 bits and D="$Berlin_{13}$TMC.GEF," which means that the data includes a data file of this name.

What is claimed is:

1. A method of transmitting digitally encoded traffic messages, the method comprising:

transmitting a traffic message according to a standardized structure, a header preceding the traffic message, at least one additional item of information following the traffic message, and one item of information containing a place description, the at least one additional item of information being divided into classes, each of the classes having a class identifier and at least one packet, one of the classes containing presentation data.

2. The method according to claim 1, wherein the standardized structure is the Traffic Message Channel method.

3. The method according to claim 1, further comprising transmitting a number of following packets after the class identifier.

4. The method according to claim 1, wherein each packet is determined by type and by data.

5. The method according to claim 1, wherein at least one packet of a class contains text data.

6. The method according to claim 1, wherein at least one packet of a class contains graphic data.

7. The method according to claim 1, wherein at least one packet of a class contains audio data.

8. The method according to claim 1, wherein at least one packet of a class contains video data.

9. The method according to claim 1, wherein a type of a packet contains a language identifier.

10. A method of transmitting digitally encoded traffic messages, the method comprising:

transmitting a traffic message according to a standardized structure, a header preceding the traffic message, at least one additional item of information following the traffic message, one item of information containing a place description, the at least one additional item of information being divided into classes, each of the classes having a class identifier and at least one packet, one of the classes containing presentation data, wherein each packet is determined by a type identifier, a length indicator and by data.

11. The method according to claim 10, wherein the standardized structure is the Traffic Message Channel method.

12. The method according to claim 10, further comprising:

transmitting a number of following packets after the class identifier.

13. The method according to claim 10, wherein at least one packet of a class contains text data.

14. The method according to claim 10, wherein at least one packet of a class contains graphic data.

15. The method according to claim 10, wherein at least one packet of a class contains audio data.

16. The method according to claim 10, wherein at least one packet of a class contains video data.

17. The method according to claim 10, wherein a type of a packet contains a language identifier.

* * * * *

UNITED STATES PATENT AND TRADEMARK OFFICE

CERTIFICATE OF CORRECTION

PATENT NO. : 6,924,751 B2 
DATED : August 2, 2005
INVENTOR(S) : Karin Hempel et al.

It is certified that error appears in the above-identified patent and that said Letters Patent is hereby corrected as shown below:

Column 2,
Line 47, change "$CL_{13}$FORMAT" to -- CL_FORMAT --.
Line 48, change "$CL_{13}$B" to -- CL_B --.
Line 48, change "$CL_{13}$N" to -- CL_N --.
Line 51, change "$CL_{13}$FORMAT" to -- CL_FORMAT --.
Line 57, change "$P_{13}$T" to -- P_T --.

Column 3,
Line 5, change "$CL_{13}$FORMAT" to -- CL_FORMAT --.
Line 17, change "$Berlin_{13}$TMC.GEF," to -- Berlin_TMC.GEF, --.

Signed and Sealed this

Thirteenth Day of June, 2006

JON W. DUDAS
*Director of the United States Patent and Trademark Office*